US008087401B2

(12) United States Patent
Inoue et al.

(10) Patent No.: US 8,087,401 B2
(45) Date of Patent: Jan. 3, 2012

(54) AUTOMOTIVE SUPERCHARGING APPARATUS

(75) Inventors: Masaya Inoue, Tokyo (JP); Yoshihito Asao, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 687 days.

(21) Appl. No.: 12/170,050

(22) Filed: Jul. 9, 2008

(65) Prior Publication Data

US 2009/0019852 A1 Jan. 22, 2009

(30) Foreign Application Priority Data

Jul. 18, 2007 (JP) ..... 2007-186882
May 20, 2008 (JP) ..... 2008-132251

(51) Int. Cl.
*F02B 33/34* (2006.01)

(52) U.S. Cl. ..... 123/559.1; 123/559.3

(58) Field of Classification Search ..... 123/559.1, 123/559.3
See application file for complete search history.

(56) References Cited

U.S. PATENT DOCUMENTS 3,795,231 A * 3/1974 Brille ..... 123/561
6,894,455 B2 * 5/2005 Cai et al. ..... 318/771
2002/0096156 A1 7/2002 Palazzolo et al.
2003/0110770 A1 6/2003 Criddle et al.
2006/0180130 A1 * 8/2006 St. James ..... 123/559.1
2010/0051363 A1 3/2010 Inoue et al.
2010/0275890 A1 * 11/2010 McDonald-Walker ..... 123/564

FOREIGN PATENT DOCUMENTS

| | | | |
|---|---|---|---|
| JP | 8-266097 | | 10/1996 |
| JP | 11-173154 | | 6/1999 |
| JP | 2001-289051 | | 10/2001 |
| JP | 2001-323818 | | 11/2001 |
| JP | 2002-242687 | | 8/2002 |
| JP | 2002-532320 | | 10/2002 |
| JP | 2003-314446 | | 11/2003 |
| JP | 2004-360487 | | 12/2004 |
| JP | 2005130656 | A * | 5/2005 |
| JP | 3686645 | | 6/2005 |
| WO | WO 2004072449 | A1 * | 8/2004 |
| WO | WO 2008/059681 | A1 | 5/2008 |

* cited by examiner

*Primary Examiner* — Thomas Denion
*Assistant Examiner* — Mary A Davis
(74) *Attorney, Agent, or Firm* — Oblon, Spivak, McClelland, Maier & Neustadt, L.L.P.

(57) ABSTRACT

An electric motor-generator and an engine are linked using a first belt that is looped around a crank pulley that is mounted to a crank shaft and a one-way clutch pulley that is mounted to a rotating shaft. An electronic control unit drives the electric motor-generator as an electric motor and drives the compressor by the electric motor-generator if engine speed is less than or equal to a predetermined value.

12 Claims, 6 Drawing Sheets

AUTOMOTIVE SUPERCHARGING APPARATUS

BACKGROUND OF THE INVENTION

1. Field of the Invention

The present invention relates to an automotive supercharging apparatus, and particularly relates to an automotive supercharging apparatus to which a centrifugal compressor is mounted that can be driven by both an engine shaft and an electric motor-generator shaft.

2. Description of the Related Art

Automotive supercharging apparatuses that function as superchargers that receive torque from a belt and a pulley that are connected to an engine pressurize air that is used by the engine to enable the engine to burn a larger quantity of fuel, thereby increasing output and torque. There are two basic types of these automotive supercharging apparatuses: positive displacement; and centrifugal. Centrifugal automotive supercharging apparatuses are more efficient than positive displacement ones, and are more lightweight, but one problem is that supercharging capacity is insufficient in low-speed regions.

Thus, multistage speed apparatuses have been proposed in which epicyclic gear sets that have a high gear ratio arrangement and a low gear ratio arrangement are disposed, and deficiencies in supercharging capacity in the low-speed region are relieved by switching to the epicyclic gear set that has the high gear ratio arrangement up to a predetermined engine speed, and switching to the epicyclic gear set that has the low gear ratio arrangement in excess of the predetermined engine speed (see Patent Literature 1, for example).

However, there is a limit to how much the gear ratio can be increased in the configuration of the epicyclic gear sets according to Patent Literature 1, and supercharging capacity of the centrifugal supercharging apparatus is insufficient in a micro-low velocity rotational frequency range from idling to approximately 1,500 rpm. Activation during engine shutdown is also fundamentally impossible, preventing sufficient boost pressure from being achieved immediately after restarts from idling reduction, etc. In diesel engine vehicles in particular, when turbo lag arises, the amount of air is insufficient, increasing particulate matter (PM).

In view of these conditions, superchargers have been proposed that include: a motor; a compressor that is disposed in an air intake system of an engine; a planetary gear mechanism that has: a sun gear that is connected to a drive shaft of the engine; planetary gears that are connected to the motor; and a ring gear that is connected to the compressor; and a control unit that drives the motor to control rotational speed of gears of the planetary gears, and control a rotational speed of the compressor independently from the rotational speed of the engine by controlling the rotational speed of the gears of the planetary gear (see Patent Literature 2, for example).

Electronically-controlled supercharging apparatuses have also been proposed in which a supercharger is driven only by a switched reactance electric motor to which power is supplied by a battery and is controlled independently from the rotational speed of the engine (see Patent Literature 3, for example).

Patent Literature 1: Japanese Patent Laid-Open No. 2002-242687 (Gazette)

Patent Literature 2: Japanese Patent Laid-Open No. 2004-360487 (Gazette)

Patent Literature 3: Japanese Patent No. 3686645 (Gazette)

In the technique according to Patent Literature 2, since it is necessary to introduce an additional motor that controls the rotational speed of the compressor, and the planetary gears, the sun gear, and the ring gear are coupled to three shafts, i.e., to the motor, to the engine, and to the compressor, one disadvantage has been that the construction of the planetary gear mechanism is complex and a high degree of control is required, increasing cost. There have also been other problems such as rotational speed control of the compressor no longer being possible if the motor fails, making continuation of operation practically impossible.

In the technique according to Patent Literature 3, because the supercharger is driven by an electric motor, one problem has been that continuation of operation becomes practically impossible if the electric motor fails. Because the supercharger is driven in a high-speed rotation region, there have also been other problems such as the electric power that is demanded of the electric motor exceeding 1 kW, requiring a high-capacity inverter and battery in low-voltage systems in the vehicle, such as the 12 V system, etc., making significant cost increases unavoidable.

SUMMARY OF THE INVENTION

The present invention aims to solve the above problems and an object of the present invention is to provide an inexpensive automotive supercharging apparatus that suppresses increases in inverter and battery capacity by coupling an existing electric motor-generator and an engine by a belt using a one-way clutch pulley so as to enable a compressor to be driven by the electric motor-generator in a low-speed region, and to be driven by the engine in a high-speed region, and also enables the compressor to be driven by the engine if the inverter fails.

In order to achieve the above object, according to one aspect of the present invention, there is provided an automotive supercharging apparatus including: an engine; an electric motor-generator that has a generating function and an electric motor function; a compressor that is disposed on intake piping of the engine; a power transmitting means that transmits driving torque from a crank shaft of the engine to a rotating shaft of the electric motor-generator; a speed increasing mechanism that transmits driving torque from the rotating shaft of the electric motor-generator to a turbine shaft of the compressor at a predetermined speed increasing ratio; a battery; an inverter that converts electric power between alternating-current and direct-current between the electric motor-generator and the battery; and a controlling means that controls the inverter. The power transmitting means includes: a crank pulley that is mounted to the crank shaft of the engine; an electric motor-generator pulley that is mounted to the rotating shaft of the electric motor-generator; a first belt that is looped around the crank pulley and the electric motor-generator pulley; and a one-way clutch pulley that is interposed between the rotating shaft of the electric motor-generator and the electric motor-generator pulley. The one-way clutch pulley is configured such that the crank shaft of the engine and the rotating shaft of the electric motor-generator operate in a disengaged state relative to each other when the driving torque from the rotating shaft of the electric motor-generator is greater than a load torque on the turbine shaft of the compressor, and the crank shaft of the engine and the rotating shaft of the electric motor-generator operate in an engaged state relative to each other when the driving torque from the rotating shaft of the electric motor-generator is less than the load torque on the turbine shaft of the compressor, and the controlling means controls the inverter so as to drive the electric motor-generator as an electric motor and drive the compressor by the electric motor-generator if engine speed is less than or equal to a predetermined value.

According to the present invention, the electric motor-generator and the engine are coupled by a belt by means of the one-way clutch pulley, and the one-way clutch pulley is configured such that the crank shaft of the engine and the rotating shaft of the electric motor-generator operate in a disengaged state relative to each other when the driving torque from the rotating shaft of the electric motor-generator is greater than the load torque on the turbine shaft of the compressor, and the crank shaft of the engine and the rotating shaft of the electric motor-generator operate in an engaged state relative to each other when the driving torque from the rotating shaft of the electric motor-generator is less than the load torque on the turbine shaft of the compressor.

Thus, the one-way clutch pulley is in a disengaged state in a low-speed region in which the load torque on the compressor is comparatively small, and the compressor is driven by the driving torque from the electric motor-generator. In a high-speed region in which the load torque on the compressor increases, because the driving torque from the electric motor-generator is insufficient on its own to drive the compressor, the one-way clutch pulley moves to the engaged state and the compressor is driven by the driving torque from the engine. Using a configuration of this kind, driving of the compressor by the electric motor-generator is limited to the low-speed region, suppressing increases in inverter and battery capacity, enabling costs to be reduced. Furthermore, because the compressor can be driven by the engine if the inverter fails, the vehicle can continue to operate.

When engine speed is less than or equal to the predetermined value, the electric motor-generator is driven as an electric motor, and the compressor is driven by the electric motor-generator. The predetermined value is an engine speed that can achieve a rotational speed of the turbine shaft at which operation of the compressor becomes effective as a supercharger, a rotational speed in the order of $4.5\times10^4$ rpm, for example. Thus, the rotational speed of the turbine shaft is increased to a rotational speed at which the compressor operates effectively as a supercharger, ensuring boost pressure. Consequently, boost pressure can be ensured even in the low-speed region during idling reduction and idling.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Embodiment 1

Figure 1:
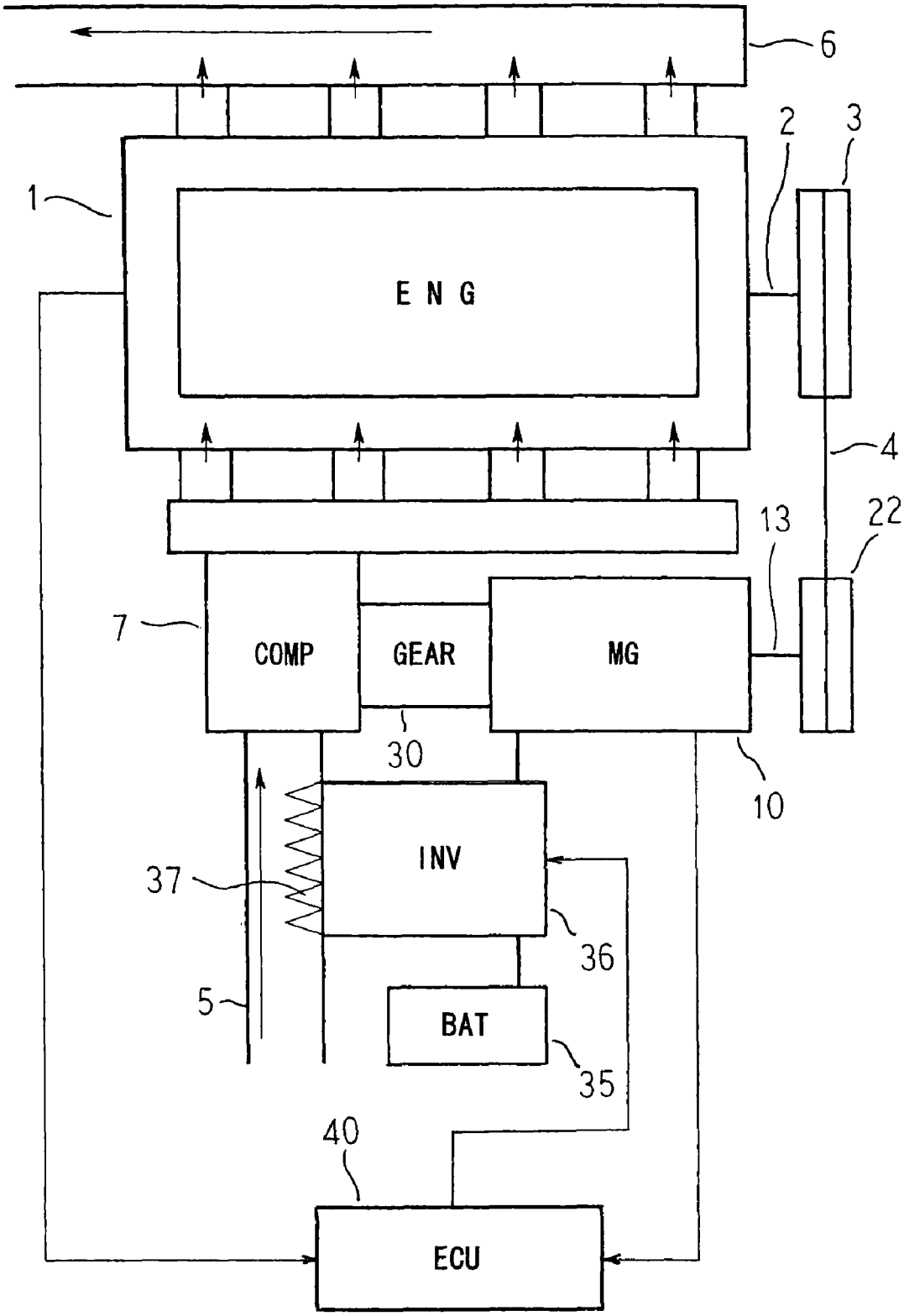
FIG. 1 is a system configuration diagram that shows an automotive supercharging apparatus according to Embodiment 1 of the present invention.
Figure 2:
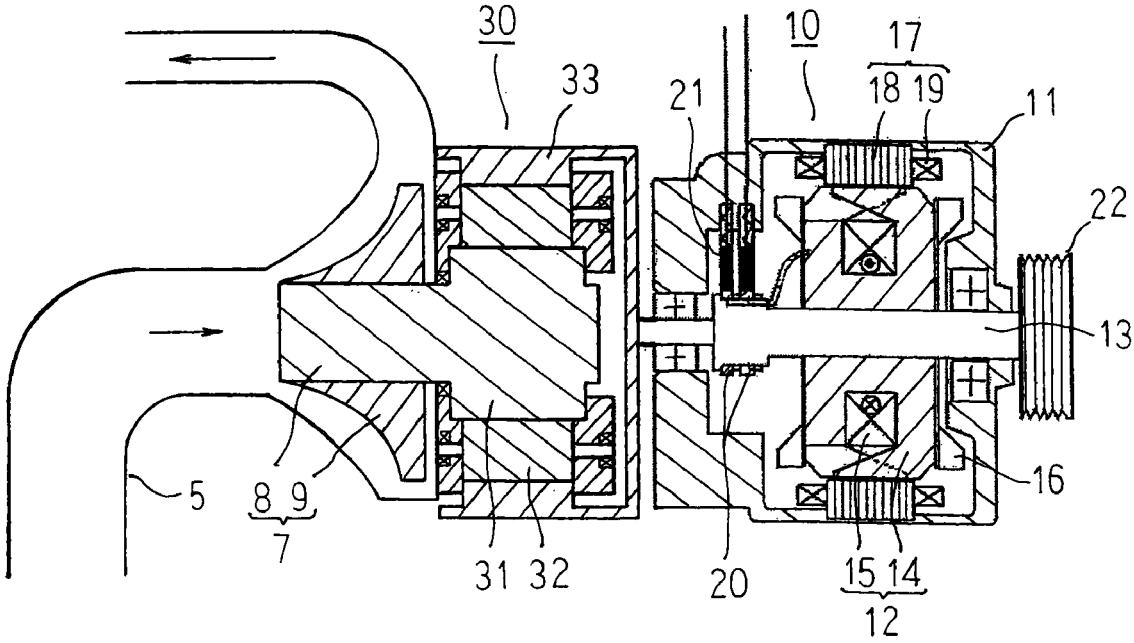
FIG. 2 is a cross section that schematically shows a power transmission pathway in the automotive supercharging apparatus according to Embodiment 1 of the present invention.
Figure 3:
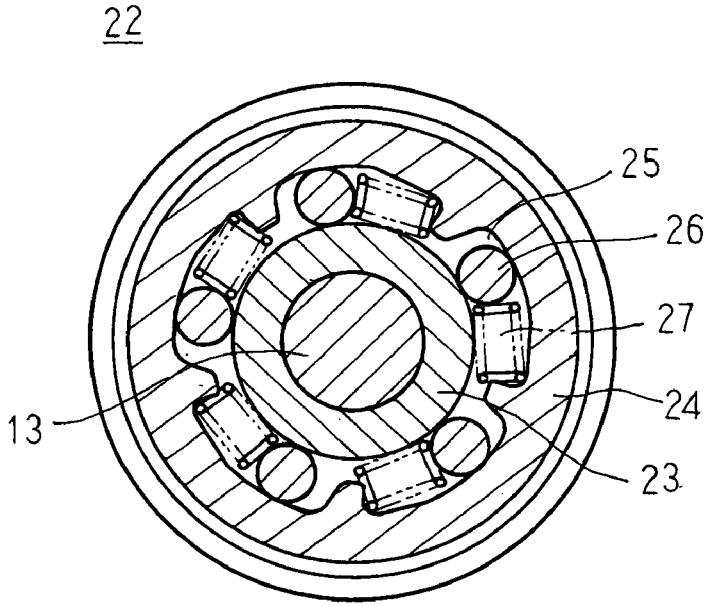
FIG. 3 is a cross section that shows a one-way clutch pulley that can be used in the automotive supercharging apparatus according to Embodiment 1 of the present invention.

FIG. 1 is a system configuration diagram that shows an automotive supercharging apparatus according to Embodiment 1 of the present invention, FIG. 2 is a cross section that schematically shows a power transmission pathway in the automotive supercharging apparatus according to Embodiment 1 of the present invention, and FIG. 3 is a cross section that shows a one-way clutch pulley that can be used in the automotive supercharging apparatus according to Embodiment 1 of the present invention.

In FIG. 1, air is supplied to an engine 1 by means of intake piping 5, and exhaust gas is discharged after combustion by means of exhaust piping 6. A crank pulley 3 is fixed to a crank shaft 2 that constitutes an output shaft of the engine 1.

An automotive supercharging apparatus includes: a compressor 7 that is disposed in the intake piping 5, and that compresses air that is supplied to the engine 1; an electric motor-generator 10 that includes an electric motor function and a generating function, to which rotational driving force (driving torque) from the engine 1 is transmitted by a first belt 4 that has been looped around the crank pulley 3 and a one-way clutch pulley 22 that is mounted to a rotating shaft 13; an epicyclic gear apparatus 30 that functions as a speed increasing mechanism that transmits rotational driving force (driving torque) from the electric motor-generator 10 to the compressor 7 at a predetermined speed increasing ratio; an inverter 36 that converts electric power between alternating-current and direct-current bidirectionally between the electric motor-generator 10 and the battery 35; and an electronic control unit 40 that functions as a controlling means. A plurality of switching elements that constitute the inverter 36 are mounted onto a heatsink 37. The heatsink 37 is disposed such that radiating fins thereof are exposed inside the intake piping 5 upstream from the compressor 7, and the switching elements are effectively cooled by a high-speed flow of intake air before the air is compressed by the compressor 7.

Although not shown, the electronic control unit 40 includes: an input interface that receives data that are sent in from respective portions of a vehicle; a central processing unit (CPU) that executes computations for performing control of the respective portions of the vehicle; a memory in which programs for performing the control of the respective portions of the vehicle and various kinds of data are stored; and an output interface that sends control signals for performing the control of the respective portions of the vehicle, etc. In this case, the electronic control unit 40 performs on-off control of the switching elements (not shown) of the inverter 36 based on the data that are sent in from the respective portions.

Next, configurations of the electric motor-generator 10, the epicyclic gear apparatus 30, and the compressor 7 will be explained with reference to FIGS. 2 and 3.

The compressor 7 includes: a turbine shaft 8; and a centrifugal fan-shaped turbine 9 that is mounted to the turbine shaft 8, and the compressor 7 compresses and conveys air in the direction of the arrows at a pressure that is greater than or equal to atmospheric pressure by driving the turbine shaft 8 to which the turbine 9 has been mounted so as to rotate.

The electric motor-generator 10 includes: a rotor 12 that is fixed to the rotating shaft 13, which is rotatably supported at a central axial position of a housing 11; and a stator that is held by the housing 11 so as to surround the rotor 12. The rotor 12 includes: a Lundell rotor core 14 that is fixed to the rotating shaft 13; and a field winding 15 that is installed in the rotor core 14. Cooling fans 16 are fixed to two axial end surfaces of the rotor core 14. The stator 17 includes: a cylindrical stator core 18; and an armature winding 19 that is installed in the stator core 18. The one-way clutch pulley 22 is mounted to a first end of the rotating shaft 13 that projects out through the housing 11. A pair of slip rings 20 that supply electric current to the field winding 15 are fixed to a portion inside the housing 11 at a second end of the rotating shaft 13. Brushes 21 are disposed so as to slide in contact with the respective slip rings 20. This electric motor-generator 10 can keep voltage constant even in applications that have a wide rotational speed range by adjusting the amount of field current that is supplied to the field winding 15 through the slip rings 20.

The one-way clutch pulley 22 is configured such that an inner clutch 23 and an outer clutch 24 are disposed concentrically, a plurality of wedge-shaped spaces 25 are formed circumferentially in a gap between the inner clutch 23 and the outer clutch 24, rollers 26 are disposed inside the respective wedge-shaped spaces 25, and springs 27 are disposed inside the wedge-shaped spaces 25 so as to force the rollers 26 in a direction in which the wedge-shaped spaces 25 become narrower (counterclockwise in FIG. 3). V-shaped grooves are formed on an outer circumferential surface of the outer clutch 24 to constitute an electric motor-generator pulley. In other words, the electric motor-generator pulley is configured integrally on the outer clutch 24. This one-way clutch pulley 22 is mounted by fixing the inner clutch 22 to the rotating shaft 13 such that the inner clutch 23 and the outer clutch 24 engage when the crank shaft 2 becomes a driving side relative to the electric motor-generator 10, and the engagement between the inner clutch 23 and the outer clutch 24 is released when the electric motor-generator 10 becomes the driving side relative to the crank shaft 2.

Here, the crank pulley 3, the one-way clutch pulley 22, and the first belt 4 constitute a power transmitting means. Furthermore, it is not necessary to constitute the electric motor-generator pulley as an integral part of the outer clutch 24, and an electric motor-generator pulley may also be prepared as a separate member and integrated by fixing it onto the outer clutch by press-fitting, etc.

The epicyclic gear apparatus 30 includes: a sun gear 31 that is coupled to the turbine shaft 8 of the compressor 7; a plurality of planet gears 32; and a ring gear 33 that is coupled to a second end of the rotating shaft 13 that projects out through the housing 11 of the electric motor-generator 10. Since the rotational speed of the electric motor-generator 10 is approximately two to three times the engine speed, it can increase only to approximately $2\times10^4$ rpm at a maximum. On the other hand, in order to operate effectively as a supercharger, the rotational speed of the compressor 7 must be at least in the order of $4\times10^4$ to $5\times10^4$ rpm. Thus, by coupling the electric motor-generator 10 to the ring gear 33 and making the sun gear 31 that is disposed on an inner circumferential side of the planet gears 32 the output shaft, this epicyclic gear apparatus 30 functions as a speed increasing gear, ensuring the rotational speed required by the compressor 7.

Now, the greater the gear ratio between the electric motor-generator 10 and the epicyclic gear apparatus 30 (speed increasing gear ratio), the higher the speed of the turbine 9, enabling supercharging capacity to be increased. However, there is an upper limit to the speed of the turbine shaft 8 due to centrifugal forces and the service life of its bearings. Specifically, the critical speed of the turbine shaft 8 is related to the product of maximum engine speed, a pulley ratio between the crank pulley 3 and the one-way clutch pulley 22, and the speed increasing gear ratio.

Maximum engine speed is normally 6,000 rpm in gasoline engine vehicles, and 5,000 rpm in diesel engine vehicles, for example. The pulley ratio between the crank pulley 3 and the one-way clutch pulley 22 is in the order of 1:2 to 1:3. In addition, the practical limit to the rotational speed of the turbine shaft 8 in order to be effective as a centrifugal supercharger that uses conventional bearings is in the order of $10\times10^4$ to $20\times10^4$ rpm. Consequently, the speed increasing gear ratio is in the order of 5 to 17 in gasoline engine vehicles, and in the order of 6 to 20 in diesel engine vehicles.

In an automotive supercharging apparatus that is configured in this manner, because an existing electric motor-generator 10 is used as a driving means for driving the compressor 7, and the sun gear 31 and the ring gear 33 of the epicyclic gear apparatus 30 are coupled to two shafts, i.e., to the compressor 7 and to the electric motor-generator, the construction of the epicyclic gear apparatus 30 is simplified, and does not require a high degree of control. Because a one-way clutch pulley 22 is used such that the compressor 7 is driven by the electric motor-generator 10 in the low-speed region, and is driven by the engine 1 in the high-speed region, electric power that is demanded of the electric motor-generator 10 is reduced, making increases in the capacity of the inverter 36 and the battery 35 no longer necessary. Thus, an inexpensive automotive supercharging apparatus can be achieved.

The electric motor-generator 10 is a Lundell automotive electric motor-generator, and is electrically controlled by the armature current that is passed to the armature winding 19 of the stator 17. Thus, the driving torque can be controlled by the armature current to the stator 17, which has a small time constant, enabling efficient utilization of driving torque and electric power.

Even if the inverter 36 fails, the compressor 7 can continue to operate by being driven by the engine 1. In addition, because the compressor 7 is driven by driving torque from the engine 1 that is transmitted by means of the first belt 4, the compressor 7 can be kept away from the high heat source of exhaust gas, enabling difficulties in integrating the compressor 7 and the electric motor-generator 10 to be eliminated.

Next, operation of an automotive supercharging apparatus that is configured in this manner will be explained in detail.

In this case, the engine 1 is a diesel engine for which the upper limit of rotational speed is 5,000 rpm, the pulley ratio between the crank shaft 2 and the one-way clutch pulley 22 is 3, the centrifugal fan-shaped turbine has a rotational speed at which operation of the compressor 7 becomes effective as a supercharger in the order of $4.5\times10^4$ rpm, and the speed increasing gear ratio is 10.

Operation 1: a case in which the engine 1 is restarted from a state in which idling of the engine 1 has been stopped for the purpose of saving energy When a need for the starting operation of the engine 1 is detected due to the starting of the engine 1 by an engine starting button, or release of a hand brake for stopping and holding the vehicle that has been locked while the vehicle was stopped, for example, the electronic control unit 40 issues a command for an engine restart. The crank shaft 2 is thereby rotated by a direct-current electric starter motor, or an alternating-current motor that is connected directly to the crank shaft 2, etc., to restart the engine 1.

Now, because the rotational speed of the crank shaft 2 at rest or immediately after starting is less than or equal to several hundred rpm, if the crank shaft 2 and the turbine shaft 8 are joined directly, the rotational speed of the turbine shaft 8 is low, and supercharging operation cannot be expected. In other words, the rotational speed of the turbine shaft 8 is significantly less than the order of $4.5\times10^4$ rpm that is effective for operation as a supercharger.

Thus, the electronic control unit 40 activates the inverter 36 simultaneously with or preceding the rotation of the crank shaft 2 by the starter or direct-coupled alternating-current motor, supplies power from the battery 35 to the electric motor-generator 10, and operates the electric motor-generator 10 as an electric motor.

The electric motor-generator 10 is driven so as to increase the rotational speed of the rotating shaft 13 to a vicinity of 4,500 rpm. The electric motor-generator 10 drives the turbine shaft 8 to rotate by means of the epicyclic gear apparatus 30, which has a speed increasing gear ratio of 10. Thus, the rotational speed of the turbine shaft 8 rises to approximately $4.5\times10^4$ rpm, and the compressor 7 operates as a supercharger. At this point, the turbine shaft 8 is in a comparatively low-speed region, and if the electric motor-generator 10 can ensure a driving torque that is greater than the driving torque required for driving the turbine, the turbine shaft 8 can be driven by the electric motor-generator 10 alone even if the rotational speed (4,500 rpm) of the rotating shaft 13 of the electric motor-generator 10 is greater than several hundred rpm (the rotational speed of the crank shaft 2) times 3 (the pulley ratio), and engagement between the inner clutch 23 and the outer clutch 24 will be released. Thus, the inner clutch 23 slips relative to the outer clutch 24, and mechanical coupling between the engine 1 and the electric motor-generator 10 is released.

Now, the turbine 9 that is driven by the electric motor-generator 10 rotates, and the flow velocity of the air that flows through the intake piping 5 increases swiftly to a predetermined value. Thus, the air inside the intake piping 5 begins to flow, and a flow arises due to inertia of the air.

Thus, because the intake pressure can be set higher than a natural intake state simultaneous with a restart of the engine 1, or immediately after a restart, and a sufficient quantity of oxygen can be ensured, responsiveness of engine drive torque to accelerator operation can be ensured from very slow speeds such as during a restart, immediately after a restart, etc.

In conventional diesel engine vehicles, if the engine speed is low as the vehicle departs, the rotational speed of the electric motor-generator 10 will be low, making the rotational speed of the turbine shaft 8 low, thereby making boost pressure insufficient. In that state, even if fuel is increased by operating the accelerator, a state of oxygen deficiency will persist and black smoke will be generated until the engine speed increases and a predetermined intake pressure is reached. In the present invention, however, because the compressor 7 is activated before, or simultaneously with, increases in fuel and engine revolution due to operating the accelerator, boost pressure can be ensured, enabling the generation of graphite that results from oxygen deficiency to be suppressed to a minimum.

Activating the compressor 7 and increasing the rotational speed of the turbine shaft 8 before increases in fuel and engine speed due to operating the accelerator is also a means for lengthening acceleration time, and has an effect of reducing driving torque by reducing the rotational angular acceleration of the electric motor-generator 10. Capacity of the inverter 36 and the battery 35 can thereby be reduced, enabling cost reductions to be achieved.

Operation 2: a case in which engine speed accelerates from an idling region immediately after starting the engine 1, or after the vehicle has stopped at traffic lights, etc.

The idling engine speed of conventional vehicles is in the order of 500 rpm. If the pulley ratio is 3, the electric motor-generator 10 will be rotating at 1,500 rpm, and will be performing power generating operation depending on the adjustment of the quantity of electric current passed to the field winding 15. In other words, the electric motor-generator 10 will be operating in a generating function. In this state, supercharging operation of the compressor 7 is not necessary, because the engine load is small.

Next, when the electronic control unit 40 detects accelerator operation as the vehicle departs, it activates the inverter 36, supplies power from the battery 35 to the electric motor-generator 10, and operates the electric motor-generator 10 as an electric motor. Then, the electric motor-generator 10 is driven to a vicinity of 4,500 rpm, at which a predetermined boost pressure is achieved. At this point, the rotational speed of the rotating shaft 13 of the electric motor-generator 10 will be greater than the rotational speed of the crank shaft 2 times the pulley ratio, and engagement between the inner clutch 23 and the outer clutch 24 will be released. Thus, the compressor 7 is driven by the electric motor-generator 10, increasing the rotational speed of the turbine shaft 8 and ensuring boost pressure. In this state, in which boost pressure is ensured, if the engine speed begins to exceed 1,500 rpm, the load torque on the turbine shaft 8 will exceed the driving torque from the electric motor-generator 10, and the electric motor-generator 10 will have difficulty driving the turbine shaft 8 on its own. As a result, the rotational speed of the rotating shaft 13 will no longer be greater than the rotational speed of the crank shaft 2 times the pulley ratio, and the inner clutch 23 and the outer clutch 24 will engage.

If ON operation of the accelerator subsequently continues further, engine speed will increase further. Then, if the engine speed exceeds 1,500 rpm, the electronic control unit 40 will reduce the electric power of the battery 35 that is supplied to the electric motor-generator 10 by means of the inverter 36, gradually reducing the driving torque from the electric motor-generator 10. In due course, driving torque from the engine 1 is transmitted to the rotating shaft 13 of the electric motor-generator 10, and driving torque from the engine 1 is transmitted to the turbine shaft 8 by means of the crank shaft 2, the crank pulley 3, the first belt 4, the one-way clutch pulley 22, the rotating shaft 13, and the epicyclic gear apparatus 30. The compressor 7 is thereby driven by the engine 1.

Now, the turbine 9 that is driven by the electric motor-generator 10 rotates, and the flow velocity of the air that flows through the intake piping 5 increases swiftly to a predetermined value. Thus, the air inside the intake piping 5 begins to flow, and a flow arises due to inertia of the air.

Thus, because the intake pressure can be set higher than atmospheric pressure even during commencement of vehicle acceleration when engine speed is low, and a sufficient quantity of oxygen can be ensured, responsiveness of engine drive torque to accelerator operation can be ensured from very slow speeds such as immediately after departure, etc.

In conventional diesel engine vehicles, if the engine speed is low as the vehicle departs, the rotational speed of the electric motor-generator 10 will be low, making the rotational speed of the turbine shaft 8 low, thereby making boost pressure insufficient. In that state, even if fuel is increased by operating the accelerator, a state of oxygen deficiency will persist and black smoke will be more likely to be generated until the engine speed increases and a predetermined intake pressure is reached. In Embodiment 1, however, because the compressor 7 is activated before, or simultaneously with, increases in fuel and engine speed due to operating the accelerator, boost pressure can be ensured, enabling the generation of graphite that results from oxygen deficiency to be suppressed to a minimum.

As engine speed begins to increase, it approaches a synchronous rotational speed of the electric motor-generator 10 that is determined by the predetermined pulley ratio. At that point, engagement between the inner clutch 23 and the outer clutch 24 can be performed smoothly by gradually weakening the accelerating driving force from the electric motor-generator 10. As a result, impacting force during engagement between the inner clutch 23 and the outer clutch 24 is weakened, enabling wear and damage to the one-way clutch pulley 22 to be reduced.

Driving of the compressor 7 can be switched so as to be driven by the engine 1 in a high-speed region and driven by the electric motor-generator 10 in a low-speed region using only the one-way clutch pulley 22, without having to use a special switching mechanism, enabling an inexpensive and highly reliable supercharging system to be achieved.

In this operation during departure, the compressor 7 is driven by the engine 1 in the high-speed region and is driven by the electric motor-generator 10 in the low-speed region, the driving torque required to operate the compressor 7 being proportional to the cube of the rotational speed of the turbine shaft 8.

If, for example, the entire region up to 4,000 rpm were driven by the electric motor-generator 10, the power that drives the electric motor-generator 10 would have to be large, i.e., 2.6 times the rotational speed and 19 times the drive output for 1,500 rpm. Significant power in the order of several kilowatts would be required by the compressor 7, and there is a risk that the inverter 36 and the battery 35 would have to be increased in size. In the present invention, because the compressor 7 is driven using the power of the engine 1 in the high-speed region where engine speed has increased, the driving torque demanded from the electric motor-generator 10 is limited to a range in the low-speed region, enabling the driving machine capacity of the electric motor-generator 10 to be reduced to several hundred watts. Thus, reductions in the size of the inverter 36 and the battery 35 are made possible, enabling an inexpensive, low-cost supercharging system to be achieved.

If the inverter 36 fails, the compressor 7 cannot be driven by the electric motor-generator 10. In that case, as the turbine shaft 8 accelerates from a low rotational speed, the turbine shaft 8 will be driven by the engine 1, and the inner clutch 23 and the outer clutch 24 will be engaged. Thus, supercharging in the low-speed region of the engine speed from idling to a vicinity of 1,500 rpm will be insufficient, but sufficient boost pressure will be ensured once the engine speed has increased through rapid acceleration, etc., and 1,500 rpm is exceeded. Thus, even in worst case conditions such as the inverter 36 failing, running at an engine speed that exceeds 1,500 rpm such as on expressways, etc., can continue with only partial performance deterioration. Consequently, the vehicle can be driven to a repair shop, etc., enabling worst case scenarios such as the vehicle being unable to move due to the fault, or extreme declines in output arising due to supercharging deficiency, etc., to be avoided.

Operation 3: a case in which a transmission is upshifted during vehicle acceleration During vehicle acceleration, if the driver continues accelerating, a transmission upshift command operation is issued, and gears are changed to a higher gear such as from 2nd gear to 3rd gear, etc. With this gear change, irrespective of whether the vehicle has an automatic transmission or a manual transmission, engine speed is reduced momentarily, and subsequently increased again to match the higher gear. If the engine speed drops suddenly, engagement between the inner clutch 23 and the outer clutch 24 is released, and coupling between the electric motor-generator 10 and the engine 1 is disconnected. Then, the electric motor-generator 10 and the compressor 7 continue to rotate due to rotational inertia, ensuring boost pressure. If the electric motor-generator 10 is operating as a generator during this speed changing operation, the electronic control unit 40 stops power generation. Then, when the engine speed increases again, the inner clutch 23 and the outer clutch 24 engage, and the compressor 7 is driven by the engine 1, ensuring boost pressure.

Now, if a simple pulley is used instead of the one-way clutch pulley 22, the rotational speed of the turbine shaft 8 will drop suddenly following the sudden drop in engine speed. The turbine 9 will become an intake resistance relative to the intake airflow in the intake piping 5 that has acquired a certain amount of intake airflow speed, leading to intake loss.

In the present invention, because the one-way clutch pulley 22 is used, coupling between the electric motor-generator 10 and the engine 1 is disconnected during the sudden drop in engine speed during the upshift of the transmission. Thus, the electric motor-generator 10 and the compressor 7 continue to rotate at high speed due to rotational inertia, maintaining the increased intake airflow speed and enabling intake loss that results from transmission upshift to be eliminated.

Even if coupling between the electric motor-generator 10 and the engine 1 is disconnected, if the electric motor-generator 10 is operating as a generator, the speed of the electric motor-generator 10 and the compressor 7 will decrease due to power generation torque.

In the present invention, because operation of the electric motor-generator 10 as a generator is prohibited, there is no speed reduction in the compressor 7 due to power generation torque. Although the speed of the compressor 7 decreases gradually due to inertial energy, the compressor 7 can maintain comparatively high-speed rotation for such a short time as the speed changing operation. As a result, intake airflow speed that has been obtained by the supercharging operation due to increases in engine speed, the compressor 7, etc., can be maintained, enabling intake pressure deficiency to be eliminated during acceleration.

In diesel engine vehicles, since there is no throttle valve, a pressure increase protection device (a blowoff valve) to protect the turbine 9 against pressure increases due to the sudden shutting of the throttle valve is also unnecessary, and failures due to always ensuring a certain amount of intake airflow speed are also rare. Thus, adopting the present supercharging apparatus in order to obtain accelerator response improvements is particularly effective in diesel engine vehicles.

Figure 7:
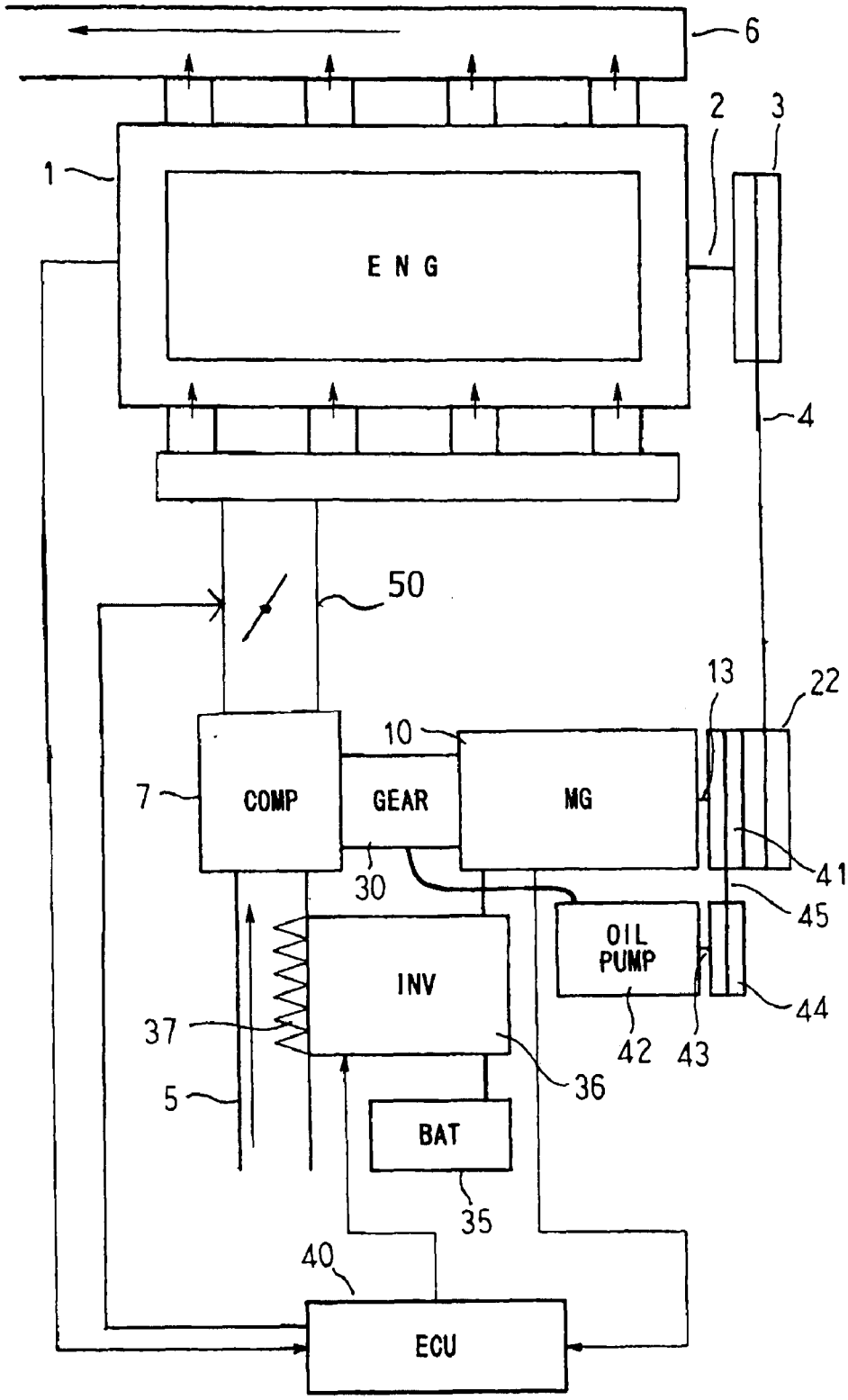
FIG. 7 illustrates a system including an intake throttle valve.

Operation 4: a case in which an intake throttle valve 50, shown in FIG. 7, operates interdependently with an accelerator accelerating operation to adjust volume of intake air As the vehicle completes acceleration and the driver reduces the amount of accelerator operation to change over to steady speed motion, engine speed decreases as a result of the reduction in the amount of accelerator operation, and engagement between the inner clutch 23 and the outer clutch 24 is released due to inertial rotation of the electric motor-generator 10. Thus, as vehicle acceleration is completed and the reduction in the amount of accelerator operation is detected, the electronic control unit 40 operates the intake throttle valve 50 in an opening direction and at the same time drives the electric motor-generator 10 as a generator.

If the driver subsequently increases the amount of accelerator operation to accelerate the vehicle, the electric motor-generator 10 is driven as an electric motor, driving the compressor 7 to rotate, and ensuring boost pressure. Then, when the engine speed has increased, operation of the electric motor-generator 10 as an electric motor is stopped, the inner clutch 23 and the outer clutch 24 engage, and the compressor 7 is driven by the engine 1.

In a region in which the engine speed is increased and the intake airflow speed is high, if the intake throttle valve 50 is closed as acceleration is completed and the change is made to steady speed motion, intake resistance arises, giving rise to pumping loss in conventional gasoline engines.

In the present invention, the electric motor-generator 10 is operated as a generator while opening the intake throttle 50 valve to minimize intake resistance. Thus, driving torque from the compressor 7 is converted to electric energy by the electric motor-generator 10, reducing the rotational speed of the turbine shaft 8. In other words, the compressor 7 is regeneratively braked, and intake resistance is increased by the turbine 9, limiting the volume of intake air. Thus, the pumping energy cast off by the throttle can be regenerated as electric power.

Embodiment 2

Figure 4:
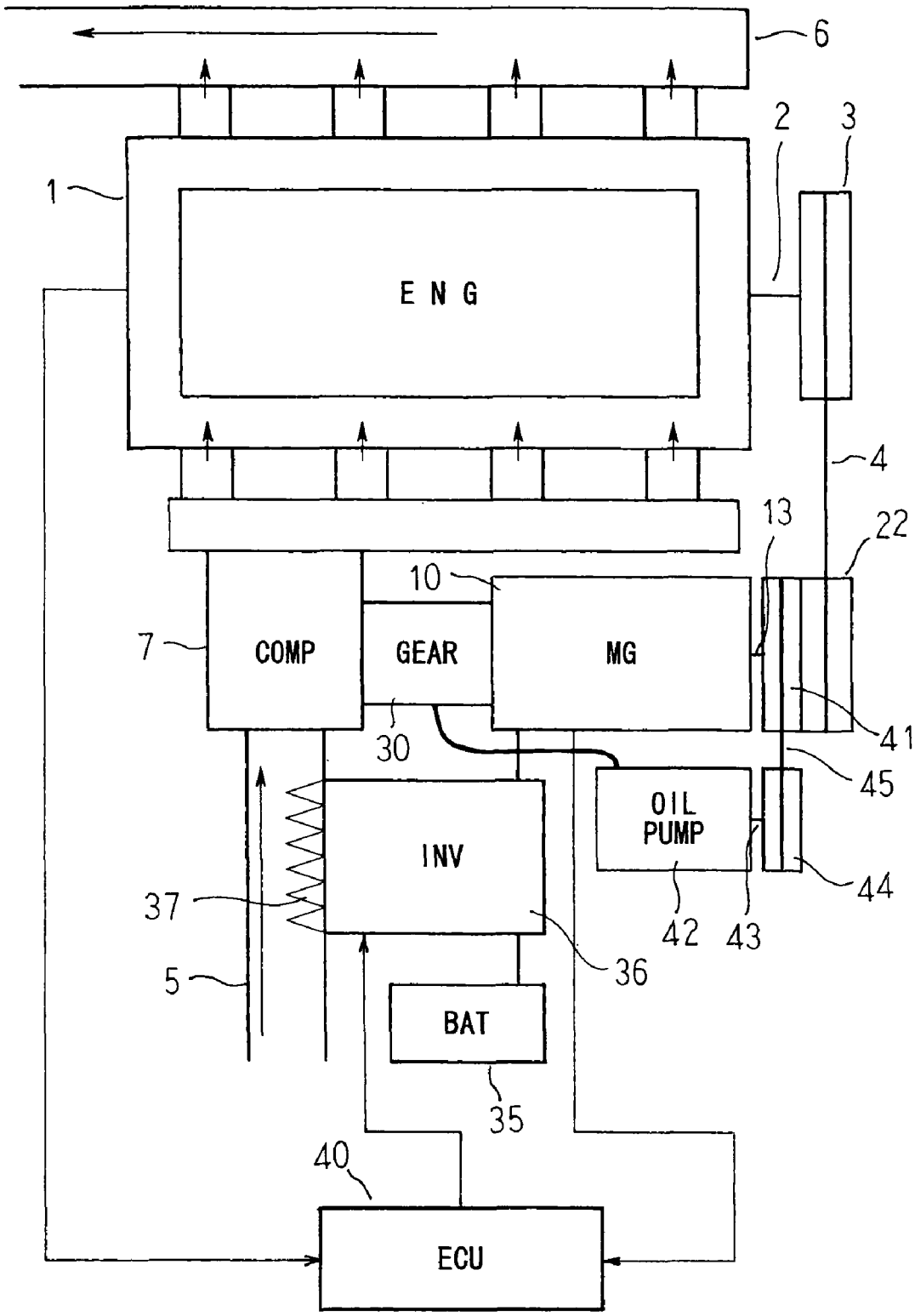
FIG. 4 is a system configuration diagram that shows an automotive supercharging apparatus according to Embodiment 2 of the present invention.

FIG. 4 is a system configuration diagram that shows an automotive supercharging apparatus according to Embodiment 2 of the present invention.

In FIG. 4, a first pulley 41 is fixed to a rotating shaft 13 alongside a one-way clutch pulley 22. An oil pump 42 includes a second pulley 44 that is fixed to a rotating shaft 43, and supplies oil to lubricate an epicyclic gear apparatus 30. A second belt 45 is looped around the first and second pulleys 41 and 44 so as to transmit driving torque from an electric motor-generator 10 to the oil pump 42.

Moreover, the rest of this embodiment is configured in a similar manner to Embodiment 1 above.

According to Embodiment 2, the oil pump 42 can be driven when the engine 1 is stopped by operating the electric motor-generator 10 as an electric motor. Thus, oil is constantly supplied to the epicyclic gear apparatus 30 from the oil pump 42 while the compressor 7 is driven at high speed by the electric motor-generator 10, enabling the occurrence of failure due to lubricating deficiency in the epicyclic gear apparatus 30 to be preemptively avoided.

Embodiment 3

Figure 5:
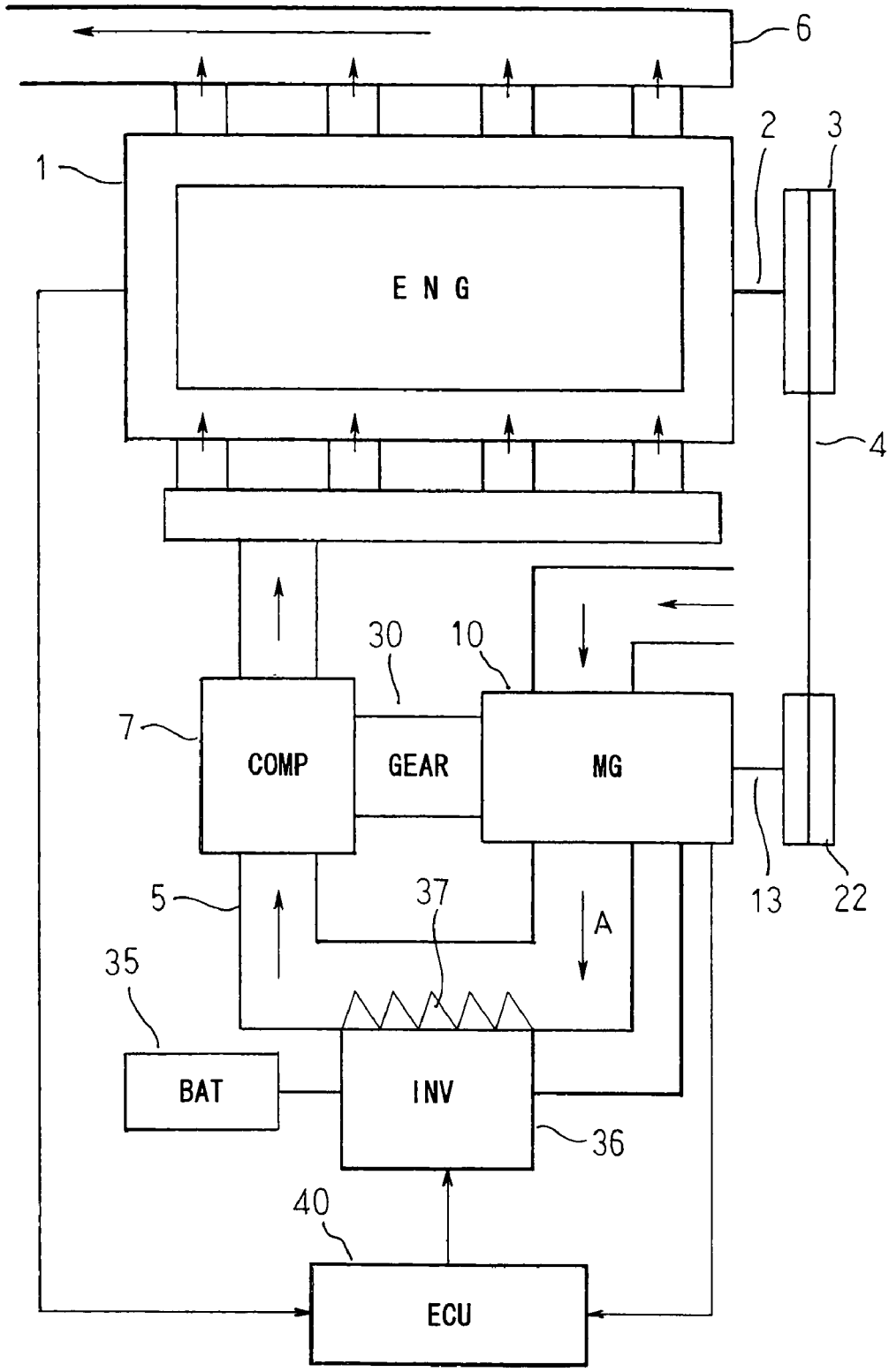
FIG. 5 is a system configuration diagram that shows an automotive supercharging apparatus according to Embodiment 3 of the present invention.
Figure 6:
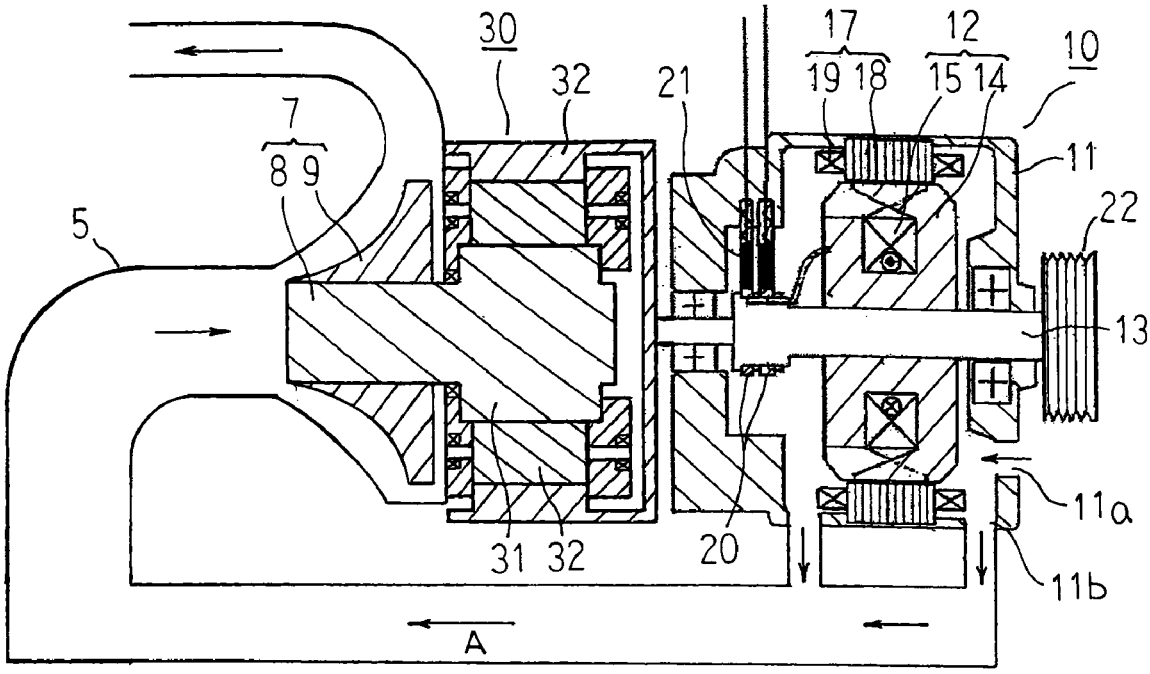
FIG. 6 is a cross section that schematically shows a power transmission pathway in the automotive supercharging apparatus according to Embodiment 3 of the present invention.

FIG. 5 is a system configuration diagram that shows an automotive supercharging apparatus according to Embodiment 3 of the present invention, and FIG. 6 is a cross section that schematically shows a power transmission pathway in the automotive supercharging apparatus according to Embodiment 3 of the present invention.

In FIGS. 5 and 6, an air intake aperture 11*a* and an air discharge aperture 11*b* are disposed on a housing 11 of an electric motor-generator 10, and intake piping 5 upstream from a compressor 7 is linked to the air discharge aperture 11*b*. Thus, an intake airflow A is formed in which air is sucked in through the air intake aperture 11*a* into the housing 11 by driving the compressor 7, cools a rotor 12 and a stator 17, is then discharged through the air discharge aperture 11*b* of the housing 11, flows through the intake piping 5, and is supplied to the compressor 7.

Moreover, the rest of this embodiment is configured in a similar manner to Embodiment 1 above.

According to Embodiment 3, because the rotor 12 and the stator 17 are cooled by the intake airflow A which is obtained by driving the compressor 7, the cooling fans 16 are no longer necessary, enabling axial size of the electric motor-generator 10 to be reduced. Thus, axial size increases that result from mounting the epicyclic gear apparatus 30 and the compressor 7 at an opposite end of the electric motor-generator 10 from a load can be canceled out to a certain extent, enabling mountability of the supercharging apparatus in restrictive engine compartments to be improved.

By incorporating diode bridges that rectify generated output from the electric motor-generator 10 into the inverter 36 with the switching elements, parts that are mounted inside the housing 11 at an opposite end from the load, such as a rectifier apparatus, etc., can be omitted, enabling further reductions in the axial size of the electric motor-generator 10.

Moreover, in each of the above embodiments, the electric motor-generator 10 uses a field rotor 12, but a permanent-magnet rotor may also be used instead of the field rotor 12. In that case, the slip rings 20 and brushes 21 will no longer be necessary, and the capacity of the inverter 36 can also be reduced.

In each of the above embodiments, the epicyclic gear apparatus 30 is used for the speed increasing mechanism, but the speed increasing mechanism is not limited to the epicyclic gear apparatus 30, and an epicyclic roller apparatus, for example, may also be used.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automotive supercharging apparatus comprising:

an engine;

an electric motor-generator that has a generating function and an electric motor function;

a compressor that is disposed on intake piping of said engine;

a power transmitting means that transmits driving torque from a crank shaft of said engine to a rotating shaft of said electric motor-generator;

a speed increasing mechanism that transmits driving torque from said rotating shaft of said electric motor-generator to a turbine shaft of said compressor at a predetermined speed increasing ratio;

a battery;

an inverter that converts electric power between alternating-current and direct-current between said electric motor-generator and said battery; and a controlling means that controls said inverter, wherein:

said power transmitting means comprises:

a crank pulley that is mounted to said crank shaft of said engine;

an electric motor-generator pulley that is mounted to said rotating shaft of said electric motor-generator;

a first belt that is looped around said crank pulley and said electric motor-generator pulley; and a one-way clutch pulley that is interposed between said rotating shaft of said electric motor-generator and said electric motor-generator pulley;

said one-way clutch pulley is configured such that said crank shaft of said engine and said rotating shaft of said electric motor-generator operate in a disengaged state relative to each other when said driving torque from said rotating shaft of said electric motor-generator is greater than a load torque on said turbine shaft of said compressor, and said crank shaft of said engine and said rotating shaft of said electric motor-generator operate in an engaged state relative to each other when said driving torque from said rotating shaft of said electric motor-generator is less than said load torque on said turbine shaft of said compressor; and said controlling means controls said inverter so as to drive said electric motor-generator as an electric motor and drive said compressor by said electric motor-generator if engine speed is less than or equal to a predetermined value, wherein said controlling means operates an intake throttle valve in an opening direction and operates said electric motor-generator as a generator if vehicle acceleration is completed and a reduction in accelerator operation is detected.

2. An automotive supercharging apparatus according to claim 1, further comprising:

a first pulley that is fixed to said rotating shaft of said electric motor-generator;

an oil pump that lubricates said speed increasing mechanism;

a second pulley that is fixed to a rotating shaft of said oil pump; and a second belt that is looped around said first pulley and said second pulley.

3. An automotive supercharging apparatus according to claim 1, wherein an air intake aperture and an air discharge aperture are disposed on a housing of said electric motor-generator, said intake piping is linked upstream from said compressor to said air discharge aperture that is disposed on said housing, and air is made to flow into said housing through said air intake aperture, flow through said housing, then be discharged through said air discharge aperture, and flow through said intake piping by driving said compressor.

4. An automotive supercharging apparatus according to claim 1, wherein said electric motor-generator is a Lundell alternating-current electric motor-generator, and is electrically controlled by an armature current that is passed to an armature winding of a stator.

5. An automotive supercharging apparatus comprising:

an engine;

an electric motor-generator that has a generating function and an electric motor function;

a compressor that is disposed on intake piping of said engine;

a power transmitting means that transmits driving torque from a crank shaft of said engine to a rotating shaft of said electric motor-generator;

a speed increasing mechanism that transmits driving torque from said rotating shaft of said electric motor-generator to a turbine shaft of said compressor at a predetermined speed increasing ratio;

a battery;

an inverter that converts electric power between alternating-current and direct-current between said electric motor-generator and said battery; and a controlling means that controls said inverter, wherein:

said power transmitting means comprises:

a crank pulley that is mounted to said crank shaft of said engine;

an electric motor-generator pulley that is mounted to said rotating shaft of said electric motor-generator;

a first belt that is looped around said crank pulley and said electric motor-generator pulley; and a one-way clutch pulley that is interposed between said rotating shaft of said electric motor-generator and said electric motor-generator pulley;

said one-way clutch pulley is configured such that said crank shaft of said engine and said rotating shaft of said electric motor-generator operate in a disengaged state relative to each other when said driving torque from said rotating shaft of said electric motor-generator is greater than a load torque on said turbine shaft of said compressor, and said crank shaft of said engine and said rotating shaft of said electric motor-generator operate in an engaged state relative to each other when said driving torque from said rotating shaft of said electric motor-generator is less than said load torque on said turbine shaft of said compressor; and said controlling means controls said inverter so as to drive said electric motor-generator as an electric motor and drive said compressor by said electric motor-generator if engine speed is less than or equal to a predetermined value, wherein said inverter comprises a heatsink, and said heatsink is disposed on said intake piping upstream from said compressor.

6. An automotive supercharging apparatus comprising:

an engine;

an electric motor-generator that has a generating function and an electric motor function;

a compressor that is disposed on intake piping of said engine;

a power transmitting means that transmits driving torque from a crank shaft of said engine to a rotating shaft of said electric motor-generator;

a speed increasing mechanism that transmits driving torque from said rotating shaft of said electric motor-generator to a turbine shaft of said compressor at a predetermined speed increasing ratio;

a battery;

an inverter that converts electric power between alternating-current and direct-current between said electric motor-generator and said battery; and a controlling means that controls said inverter, wherein:

said power transmitting means comprises:

a crank pulley that is mounted to said crank shaft of said engine;

an electric motor-generator pulley that is mounted to said rotating shaft of said electric motor-generator;

a first belt that is looped around said crank pulley and said electric motor-generator pulley; and a one-way clutch pulley that is interposed between said rotating shaft of said electric motor-generator and said electric motor-generator pulley;

said one-way clutch pulley is configured such that said crank shaft of said engine and said rotating shaft of said electric motor-generator operate in a disengaged state relative to each other when said driving torque from said rotating shaft of said electric motor-generator is greater than a load torque on said turbine shaft of said compressor, and said crank shaft of said engine and said rotating shaft of said electric motor-generator operate in an engaged state relative to each other when said driving torque from said rotating shaft of said electric motor-generator is less than said load torque on said turbine shaft of said compressor; and said controlling means controls said inverter so as to drive said electric motor-generator as an electric motor and drive said compressor by said electric motor-generator if engine speed is less than or equal to a predetermined value, wherein said controlling means controls said electric motor-generator to prohibit the electric motor-generator from operating as a generator during upshift of a transmission during vehicle acceleration, and wherein said compressor continues to rotate due to rotational inertia of said electric motor-generator during a sudden drop of engine speed during the upshift of the transmission.

7. An automotive supercharging apparatus comprising:

an engine;

an electric motor-generator that has a generating function and an electric motor function;

a compressor that is disposed on intake piping of said engine;

a power coupler that transmits driving torque from a crank shaft of said engine to a rotating shaft of said electric motor-generator;

a speed increasing mechanism that transmits driving torque from said rotating shaft of said electric motor-generator to a turbine shaft of said compressor at a predetermined speed increasing ratio;

a battery;

an inverter that converts electric power between alternating-current and direct-current between said electric motor-generator and said battery; and a controller that controls said inverter, wherein:

said power coupler comprises:

a crank pulley that is mounted to said crank shaft of said engine;

an electric motor-generator pulley that is mounted to said rotating shaft of said electric motor-generator;

a first belt that is looped around said crank pulley and said electric motor-generator pulley; and a one-way clutch pulley that is interposed between said rotating shaft of said electric motor-generator and said electric motor-generator pulley;

said one-way clutch pulley is configured such that said crank shaft of said engine and said rotating shaft of said electric motor-generator operate in a disengaged state relative to each other when said driving torque from said rotating shaft of said electric motor-generator is greater than a load torque on said turbine shaft of said compressor, and said crank shaft of said engine and said rotating shaft of said electric motor-generator operate in an engaged state relative to each other when said driving torque from said rotating shaft of said electric motor-generator is less than said load torque on said turbine shaft of said compressor; and said controller controls said inverter so as to drive said electric motor-generator as an electric motor and drive said compressor by said electric motor-generator if engine speed is less than or equal to a predetermined value, wherein said controller operates an intake throttle valve in an opening direction and operates said electric motor-generator as a generator if vehicle acceleration is completed and a reduction in accelerator operation is detected.

8. An automotive supercharging apparatus according to claim 7, further comprising:

a first pulley that is fixed to said rotating shaft of said electric motor-generator;

an oil pump that lubricates said speed increasing mechanism;

a second pulley that is fixed to a rotating shaft of said oil pump; and a second belt that is looped around said first pulley and said second pulley.

9. An automotive supercharging apparatus according to claim 7, wherein said inverter comprises a heatsink, and said heatsink is disposed on said intake piping upstream from said compressor.

10. An automotive supercharging apparatus according to claim 7, wherein an air intake aperture and an air discharge aperture are disposed on a housing of said electric motor-generator, said intake piping is linked upstream from said compressor to said air discharge aperture that is disposed on said housing, and air is made to flow into said housing through said air intake aperture, flow through said housing, then be discharged through said air discharge aperture, and flow through said intake piping by driving said compressor.

11. An automotive supercharging apparatus according to claim 7, wherein said controller controls said electric motor-generator to prohibit the electric motor-generator from operating as a generator during upshift of a transmission during vehicle acceleration.

12. An automotive supercharging apparatus according to claim 7, wherein said electric motor-generator is a Lundell alternating-current electric motor-generator, and is electrically controlled by an armature current that is passed to an armature winding of a stator.

* * * * *